US006222107B1

(12) United States Patent
Lo

(10) Patent No.: US 6,222,107 B1
(45) Date of Patent: Apr. 24, 2001

(54) FLOOR TOM FREE-SUSPENSION SYSTEM

(76) Inventor: David Lo, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/571,436

(22) Filed: May 15, 2000

(51) Int. Cl.[7] ..... G10D 13/02

(52) U.S. Cl. ..... 84/421; 84/411 R; 84/327; 248/188

(58) Field of Search ..... 84/421, 411 R, 84/327; 248/440, 188, 223.41

(56) References Cited

U.S. PATENT DOCUMENTS 5,088,669 * 2/1992 Zinnbauer ..... 248/188.9
5,454,288 * 10/1995 Hoshino ..... 84/421
5,998,717 * 12/1999 Chen ..... 84/421

* cited by examiner

*Primary Examiner*—Shih-Yung Hsieh

(57) ABSTRACT

A floor tom free-suspension system has a drum main body, three support rods, a counterhoop, an annular ring, a collar, a plurality of U-shaped positioning plates, a plurality of U-shaped pressing plates, and a plurality of butterfly bolts. A plurality of positioning fasteners are disposed on the drum main body. The collar encloses a lower rim, of the drum main body. The annular ring encloses the collar. The counterhoop encloses an upper rim of the drum main body. Each of the support rods is fastened on the annular ring by a U-shaped positioning plate and a butterfly bolt.

1 Claim, 6 Drawing Sheets

FLOOR TOM FREE-SUSPENSION SYSTEM

BACKGROUND OF THE INVENTION

The present invention relates to a floor tom free-suspension system. More particularly, the present invention relates to a floor tom free-suspension system which can receive a drum stably.

Referring to FIG. 1, a conventional floor tom free-suspension system has a drum main body 10 supported by three support rods 14. Each of the support rods 14 has a foot end 18 and an upper end 15 passing through a through hole 13 of a positioning mount 12. The positioning mount 12 has the through hole 13 receiving the respective support rod 14 and a threaded hole 16 receiving a butterfly bolt 17. However, the butterfly bolt 17 cannot fasten the respective support rod 14 stably so that the respective support rod 14 will rotate freely.

SUMMARY OF THE INVENTION

An object of the present invention is to provide a floor tom free-suspension system which can receive a drum stably.

Another object of the present invention is to provide a floor tom free-suspension system which has a plurality of U-shaped positioning plates to confine a plurality of support rods so that the support rods will not rotate freely.

Accordingly, a floor tom free-suspension system comprises a drum main body, three support rods, a counterhoop, an annular ring, a collar, a plurality of U-shaped positioning plates, a plurality of U-shaped pressing plates, and a plurality of butterfly bolts. The drum main body has a top head. A plurality of positioning fasteners are disposed on the drum main body. Each of the positioning fasteners has a threaded end. The counterhoop encloses an upper rim of the drum main body. Each of the support rods has a foot end, an upper end, and a plurality of periphery serrations. The collar has a plurality of periphery seats. Each of the periphery seats has a round aperture matching the respective positioning fastener. The annular ring has a plurality of inner wings matching the periphery seats. Each of the inner wings has an oblong hole. Each of the U-shaped positioning plates has a main plate and two lug plates. The main plate has a threaded aperture. Each of the lug plates has a round hole and a plurality of inner teeth. Each of the U-shaped pressing plates has a first arm, a second arm, and a through hole. Each of the butterfly bolts has a threaded portion. The collar encloses a lower rim of the drum main body. The annular ring encloses the collar. A plurality of elastic cushions each is disposed on the respective inner wing. Each of the positioning fasteners passes through the respective elastic cushion, the respective oblong hole of the inner wing, and the respective round aperture of the periphery seat. A plurality of nuts each engages with the respective threaded end of the positioning fastener. Each of the U-shaped positioning plates receives the annular ring. Each of the U-shaped pressing plates receives the respective main plate of the U-shaped positioning plates. The upper end of the support rod passes through the respective round hole of the lug plate. The inner teeth of the lug plate engages with the periphery serrations of the support rod. Each of the butterfly bolts passes through the respective through hole of the U-shaped pressing plates and the respective threaded aperture of the U-shaped positioning plate to fasten the U-shaped pressing plate and the U-shaped positioning plate together.

DETAILED DESCRIPTION OF THE INVENTION

Figure 1:
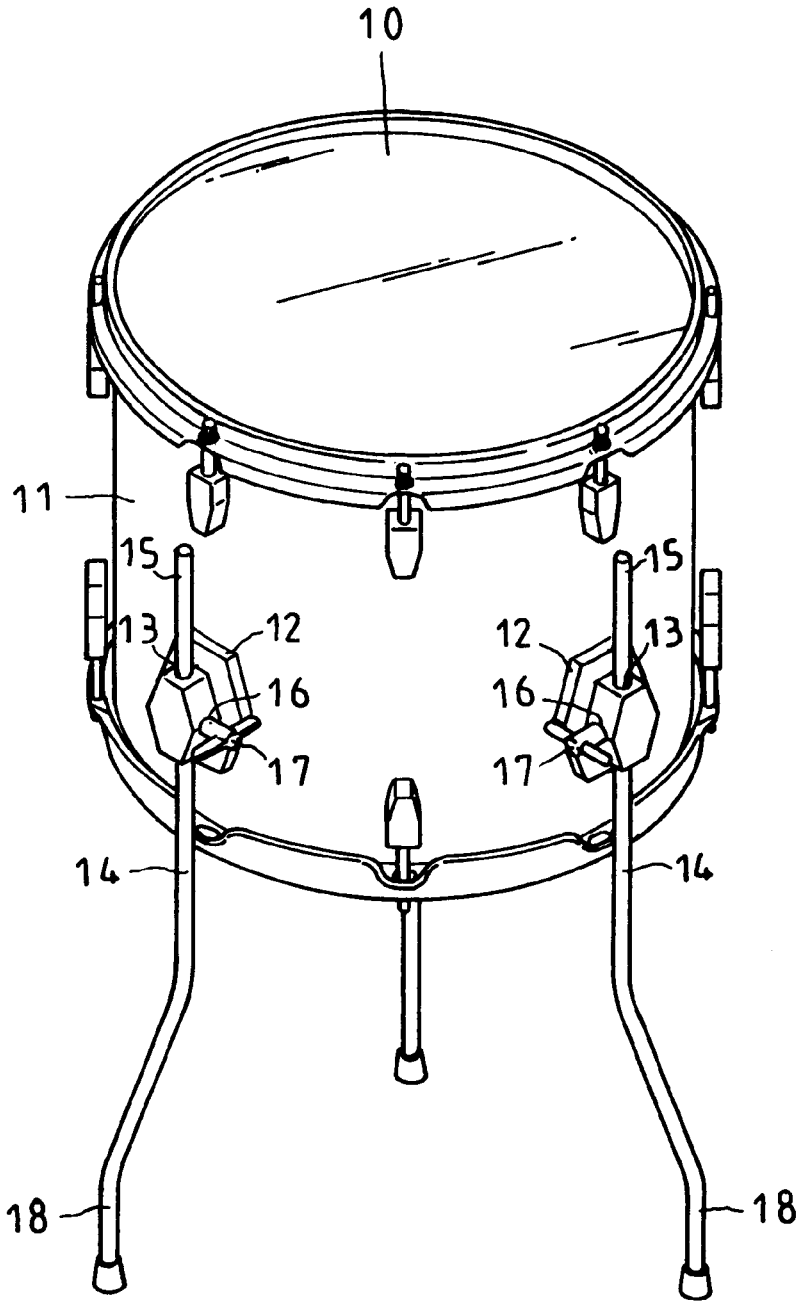
F I G. 1 PRIOR ART
FIG. 1 is a perspective assembly view of a conventional floor tom free-suspension system of the prior art.
Figure 2:
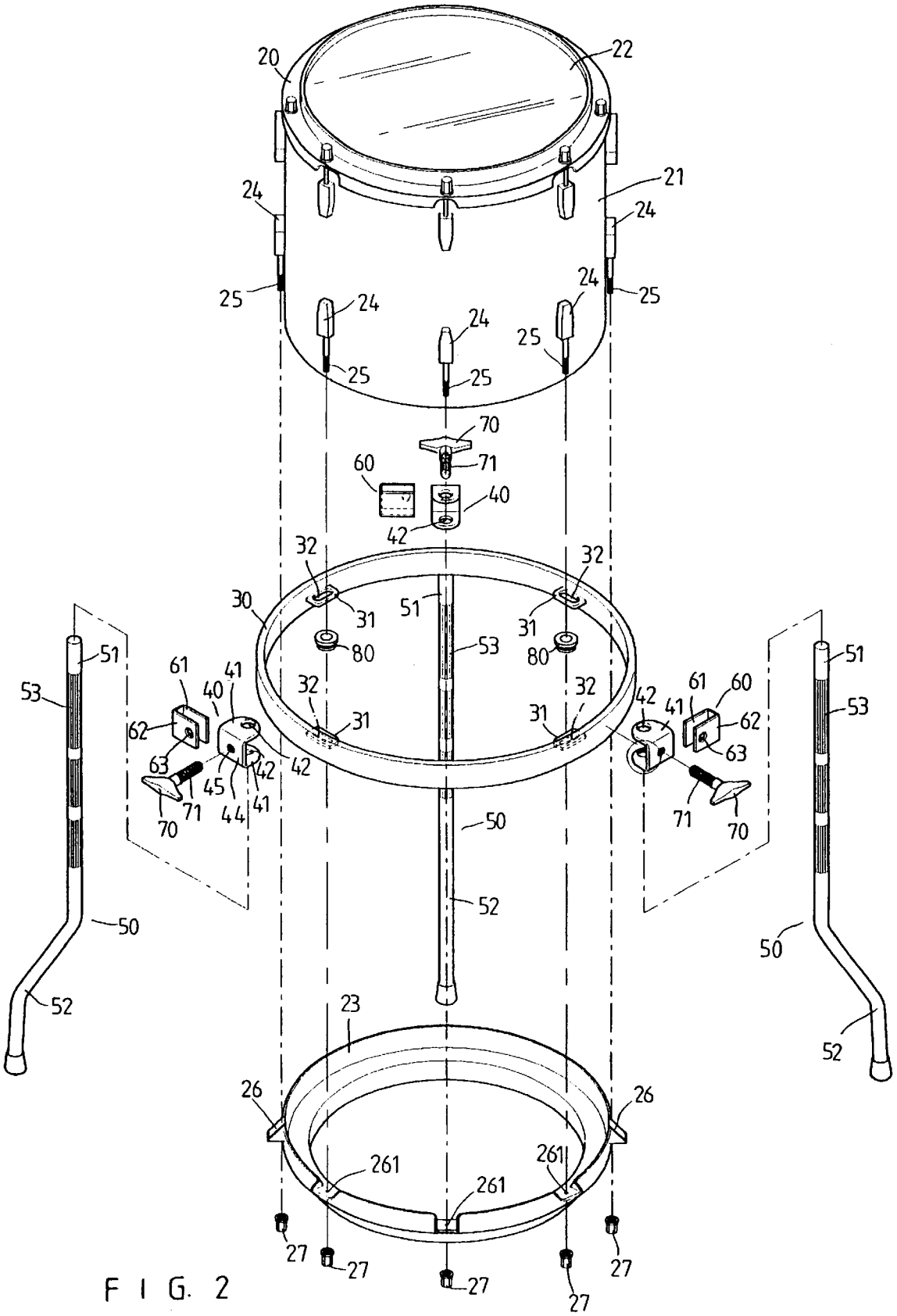
FIG. 2 is a perspective exploded view of a floor tom free-suspension system of a preferred embodiment in accordance with the present invention.
Figure 2A:
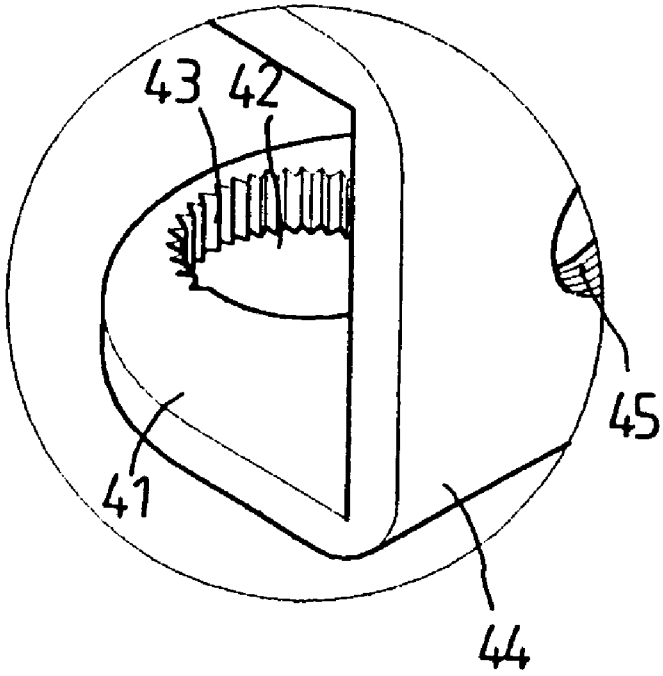
FIG. 2A is a partially perspective view of a U-shaped positioning plate of a preferred embodiment in accordance with the present invention.
Figure 3A:
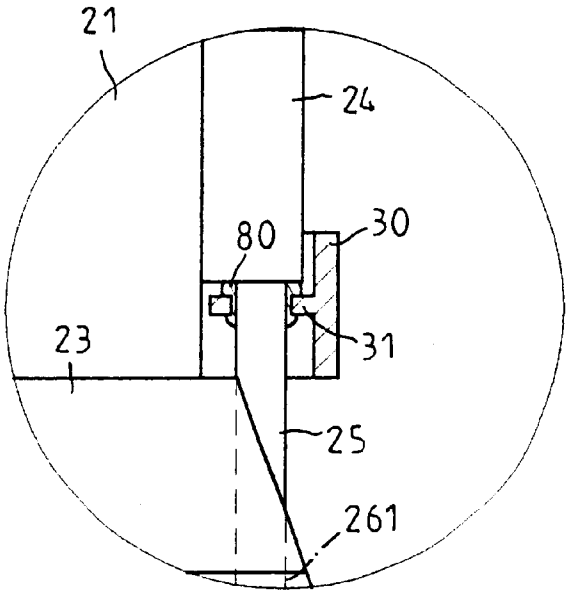
FIG. 3A is a sectional assembly view of an annular ring, a positioning fastener, and an elastic cushion of a preferred embodiment in accordance with the present invention.
Figure 3:
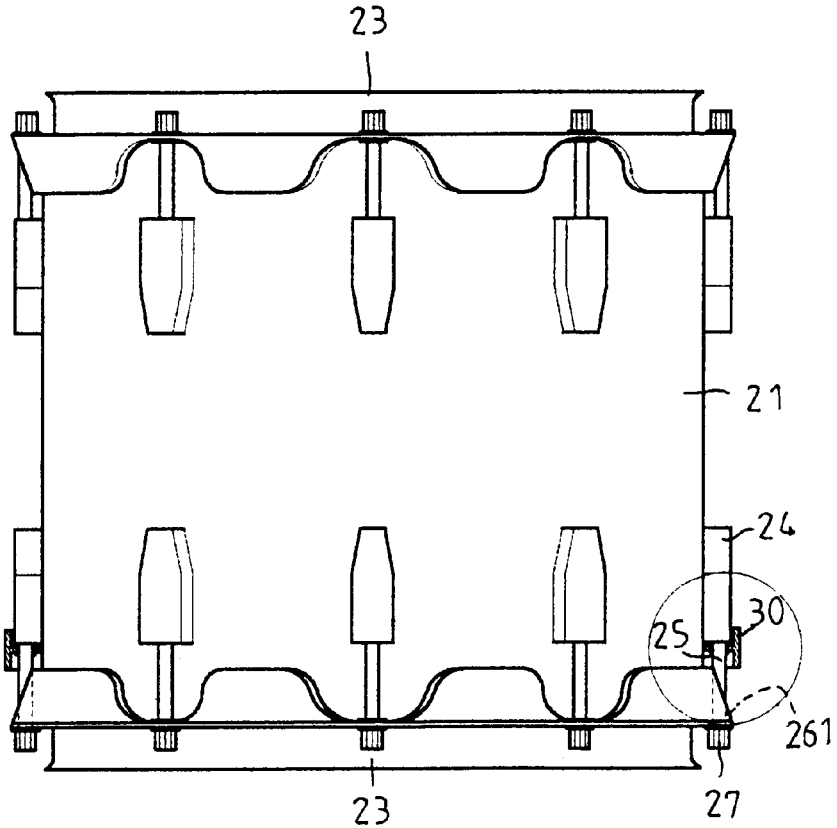
FIG. 3 is an elevational view of a drum main body of a preferred embodiment in accordance with the present invention.
Figure 4A:
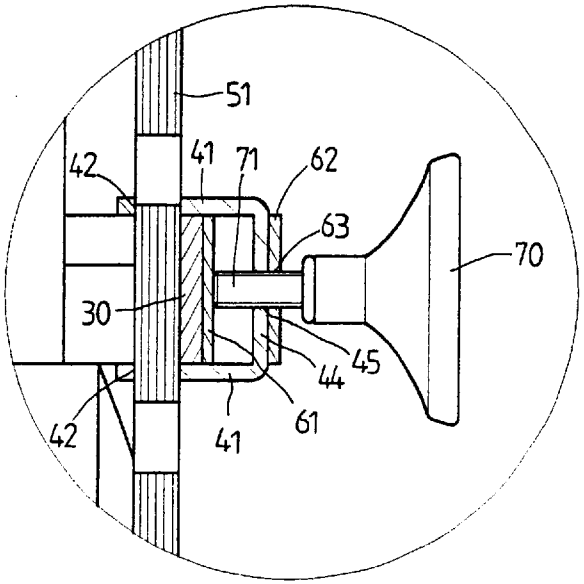
FIG. 4A is a sectional assembly view of an annular ring, a support rod, a U-shaped positioning plate, a U-shaped pressing plate, and a butterfly bolt of a preferred embodiment in accordance with the present invention.
Figure 4:
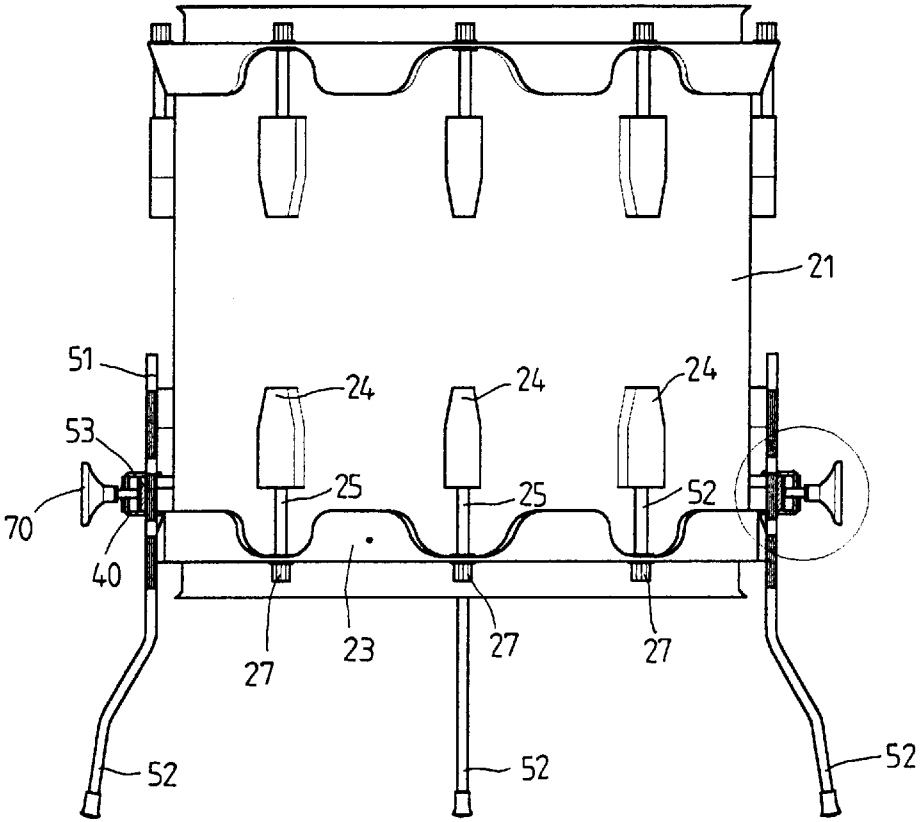
FIG. 4 is an elevational view of a floor tom free-suspension system of a preferred embodiment in accordance with the present invention.
Figure 5:
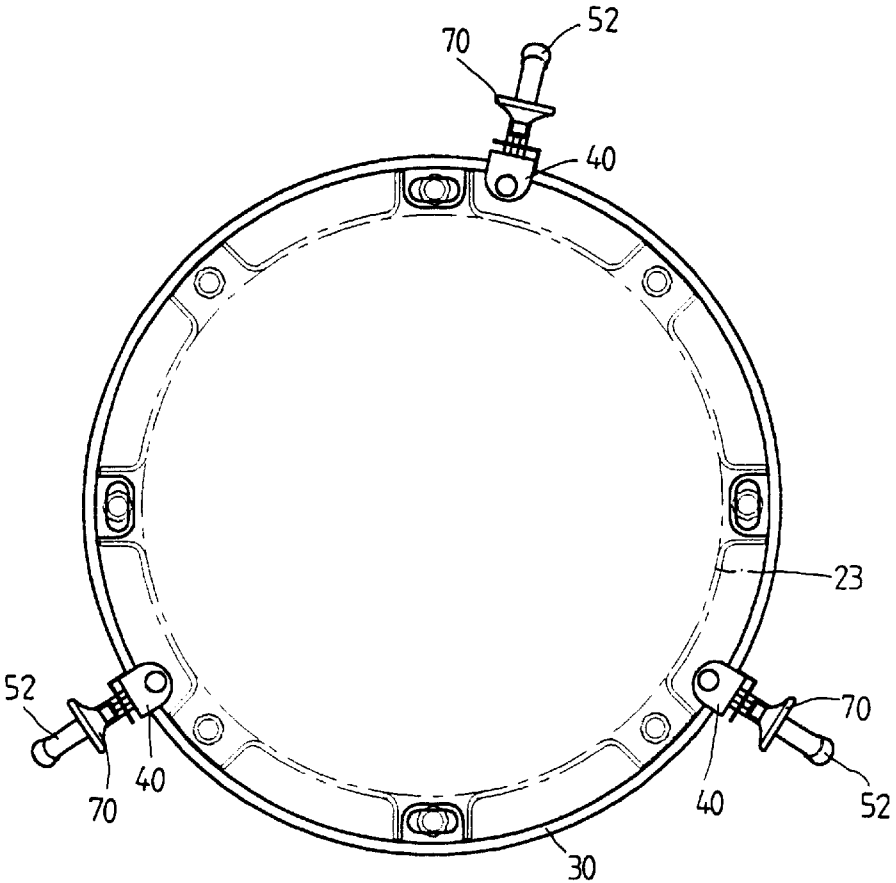
FIG. 5 is a bottom plan view of a floor tom free-suspension system of a preferred embodiment in accordance with the present invention.

Referring to FIGS. 2 to 5, a floor tom free-suspension system comprises a drum main body 21, three support rods 50, a counterhoop 20, an annular ring 30, a collar 23, a plurality of U-shaped positioning plates 40, a plurality of U-shaped pressing plates 60, and a plurality of butterfly bolts 70.

The drum main body 21 has a top head 22. A plurality of positioning fasteners 24 are disposed on the drum main body 21.

Each of the positioning fasteners 24 has a threaded end 25.

The counterhoop 20 encloses an upper rim of the drum main body 21.

Each of the support rods 50 has a foot end 52, an upper end 51, and a plurality of periphery serrations 53.

The collar 23 has a plurality of periphery seats 26. Each of the periphery seats 26 has a round aperture 261 matching the respective positioning fastener 24.

The annular ring 30 has a plurality of inner Wings 31 matching the periphery seats 26. Each of the inner wings 31 has an oblong hole 32.

Each of the U-shaped positioning plates 40 has a main plate 44 and two jug plates 41. The main plate 44 has a threaded aperture 45. Each of the lug plates 41 has a round hole 42 and a plurality of inner teeth 43.

Each of the U-shaped pressing plates 60 has a first arm 61, a second arm 62, and a through hole 63.

Each of the butterfly bolts 70 has a threaded portion 71.

The collar 23 encloses a lower rim of the drum main body 21.

The annular ring 30 encloses the collar 23.

A plurality of elastic cushions 80 each is disposed on the respective inner wing 31.

Each of the positioning fasteners 24 passes through the respective elastic cushion 80, the respective oblong hole 32 of the inner wing 31, and the respective round aperture 261 of the periphery seat 26.

A plurality of nuts 27 each engages with the respective threaded end 25 of the positioning fastener 24.

Each of the U-shaped positioning plates 40 receives the annular ring 30.

Each of the U-shaped pressing plates 60 receives the respective main plate 44 of the U-shaped positioning plates 40.

The upper end 51 of the support rod 50 passes through the respective round hole 42 of the lug plate 41.

The inner teeth 43 of the lug plate 41 engages with the periphery serrations 53 of the support rod 50. Thus the support rod 50 cannot be rotated freely.

Each of the butterfly bolts 70 passes through the respective through hole 63 of the U-shaped pressing plates 60 and the respective threaded aperture 45 of the U-shaped positioning plate 40 to fasten the U-shaped pressing plate 60 and the U-shaped positioning plate 40 together.

The invention is not limited to the above embodiment but various modification thereof may be made. Further, various changes in form and-detail may be made without departing from the scope of the invention.

I claim:

1. A floor tom free-suspension system comprising:

a drum main body, three support rods, a counterhoop, an annular ring, a collar, a plurality of U-shaped positioning plates, a plurality of U-shaped pressing plates, and a plurality of butterfly bolts, the drum main body having a top head, a plurality of positioning fasteners disposed on the drum main body, each of the positioning fasteners having a threaded end, the counterhoop enclosing an upper rim of the drum main body, each of the support rods having a foot end, an upper end, and plurality of periphery serrations, the collar having a plurality of periphery seats, each of the periphery seats having a round aperture matching the respective positioning fastener, the annular ring having a plurality of inner wings matching the periphery seats, each of the inner wings having an oblong hole, each of the U-shaped positioning plates having a main plate and two lug plates, the main plate having a threaded aperture, each of the lug plates having a round hole and a plurality of inner teeth, each of the u-shaped pressing plates having a first arm, a second arm, and a through hole, each of the butterfly bolts having a threaded portion, the collar enclosing a lower rim of the drum main body, the annular ring enclosing the collar, a plurality of elastic cushions each disposed on the respective inner wing, each of the positioning fasteners passing through the respective elastic cushion, the respective oblong hole of the inner wing, and the respective round aperture of the periphery seat, a plurality of nuts each engaging with the respective threaded end of the positioning fastener, each of the U-shaped positioning plates receiving the annular ring, each of the U-shaped pressing plates receiving the respective main plate of the U-shaped positioning plates, the upper end of the support rod passing through the respective round hole of the lug plate, the inner teeth of the lug plate engaging with the periphery serrations of the support rod, and each of the butterfly bolts passing through the respective through hole of the U-shaped pressing plates and the respective threaded aperture of the U-shaped positioning plate to fasten the U-shaped pressing plate and the U-shaped positioning plate together.

* * * * *